United States Patent [19]

Buck et al.

[11] Patent Number: 5,069,627

[45] Date of Patent: Dec. 3, 1991

[54] ADJUSTABLE STACKING CONNECTOR FOR ELECTRICALLY CONNECTING CIRCUIT BOARDS

[75] Inventors: Jonathan E. Buck, Harrisburg; John W. Kaufman, Hershey, both of Pa.

[73] Assignee: AMP Incorporated, Harrisburg, Pa.

[21] Appl. No.: 540,038

[22] Filed: Jun. 19, 1990

[51] Int. Cl.[5] ..... H01R 9/09

[52] U.S. Cl. ..... 439/66; 439/591

[58] Field of Search ..... 439/66, 74, 75, 67, 439/591; 361/412, 413

[56] References Cited

U.S. PATENT DOCUMENTS

| | | | |
|---|---|---|---|
| 627,516 | 6/1899 | Morgan | 248/407 |
| 2,748,261 | 5/1956 | Wolar | 248/407 |
| 3,129,990 | 4/1964 | Rice et al. | 439/864 |
| 3,795,037 | 3/1974 | Luttmer | 29/628 |
| 3,985,413 | 10/1976 | Evans | 339/17 LM |
| 4,161,346 | 7/1979 | Cherian et al. | 339/17 M |
| 4,597,626 | 7/1986 | Gabbard et al. | 339/184 M |
| 4,634,199 | 1/1987 | Anhalt et al. | 339/17 M |
| 4,636,018 | 1/1987 | Stillie | 339/17 M |
| 4,752,231 | 6/1988 | Olsson | 439/66 |

FOREIGN PATENT DOCUMENTS 0180284 10/1985 European Pat. Off. .

*Primary Examiner*—Neil Abrams

*Attorney, Agent, or Firm*—Katherine A. Nelson

[57] ABSTRACT

An electrical connector (20) for electrically connecting circuit boards (30,32) or the like comprises two housings (22,24) engaged via a plurality of tongues (100) and grooves (102) positioned on each housing (22,24). The grooves (102) of one housing (22) receive the tongues (100) of the other housing (24), and vice versa, by sliding one into the other. A plurality of interlocks (104) formed on each tongue (100) of one housing (22) mate with interlocks (104) formed on the grooves (102) of the other housing (24) to form a rugged spacer (25). By positioning the housings (22,24) so that different interlocks (104) slide together, one of a plurality of preselected distances may be achieved to match the spacing between circuit boards (30,32). An electrical circuit conductor (26) is positioned on the spacer (25) to provide for electrical connection between the circuit boards (30,32). A resilient bias means (74) biases the electrical circuit conductor (26) into electrical engagement with electrical circuitry (27,28) on the circuit boards (30,32). A protective latch (36) is positioned over the connector (20) to protect the conductor (26) from damage. Each housing (22,24) includes positioning means (70) formed on each housing (22,24) to assure proper mating of the connector (20) to the circuit boards (30,32), and aligning means (74) formed to align the conductor (26) to each circuit board (30,32).

20 Claims, 6 Drawing Sheets

ADJUSTABLE STACKING CONNECTOR FOR ELECTRICALLY CONNECTING CIRCUIT BOARDS

FIELD OF THE INVENTION

This invention relates to an improved connector for spacing and electrically connecting spaced apart circuit boards or the like. More particularly, the electrical connector of this invention may be adjusted to fit any one of a plurality of circuit board spacings while interconnecting the electrical circuitry of the circuit boards having a plurality of electrical conductive paths with a common conductor.

BACKGROUND OF THE INVENTION

Electrical connectors are used to electrically connect electrical circuit boards which are physically spaced apart and parallel to each other. Such connectors need to provide an appropriate space between circuit boards for component positioning and cooling and yet provide for the electrical interconnection between parallel arrays of circuit boards, substrate devices or the like having a plurality of electrical conductive paths. Typically, electrical connectors were specifically designed to fit one defined space between the circuit boards, and if a different spacing was required, another connector scaled to fit that spacing was required. For example, U.S. Pat. No. 4,752,231 describes an electrical connector designed for use between spaced apart circuit boards having a single defined space between printed circuit boards assembled in parallel planes. U.S. Pat. No. 4,636,018 describes a unitary elastomeric electrical connector having a plurality of electrical conductors which extend beyond the connector body and are placed into compression contact when the circuit boards are assembled. European Pat. No. 0 180 284 describes an electrical connector for a printed circuit board comprising a one-piece metal shell having a plurality of spring fingers engaging the connector housing.

Similarly, U.S. Pat. No. 4,161,346 describes a connecting element for circuit boards having a symmetrical, sinuous shape to provide a spring section for exerting a predetermined contact force. U.S. Pat. No. 3,795,037 describes an electrical connector comprising a plurality of elongated flexible conductors embedded in, and extending between, the surfaces of a block of elastomeric insulating material which biases the connectors into proper electrical connection.

If a different spacing between the circuit boards was required, a rescaled new electrical connector was designed and fabricated at considerable expense to the manufacturer. Each rescaled electrical connector required a rescaled circuit interconnection means, or electrical circuit conductor, which had to be specifically designed for a particular circuit board spacing. This required electrical connector manufacturers to maintain a large inventory of expensive electrical connectors for a variety of specific circuit board spacings and electrical circuit conductors. For example, U.S. Pat. No. 4,634,199 describes an electrical connector for a small space between a pair of circuit boards having a row of contact elements with bent middle portions which nest in one another U.S. Pat. No. 3,985,413 describes a miniature electrical connector comprising a cylindrical elastomeric body having a thin non-yielding flexible circuit wrapped around the elastomeric body.

Also, mismatched electrical connectors of various spacings created problems. U.S. Pat. No. 4,597,626 describes a key block arrangement which prevents an electrical connector having a width greater than a predetermined size from being inserted into a circuit pack carrier.

None of the patents described above provides the important advantages of an electrical connector having adjustable spacing to electrically interconnect two parallel printed circuit boards. Unlike the prior art described above, the electrical connector of the present invention may be assembled to accommodate a range of circuit board spacings while providing electrical circuitry connection to a plurality of conductive paths by a common electrical conductor.

SUMMARY OF THE INVENTION

It is an objective of the present invention to provide an electrical connector for circuit boards or the like which can be adjusted to any one of a plurality of predetermined space settings.

It is a further objective to provide an electrical connector which allows one common electrical circuit conductor to be used to connect a plurality of electrical conductive paths in any of the plurality of predetermined spaces.

It is also a further objective to provide resilient bias means to bias the electrical circuit conductor into precise electrical contact with the electrical circuitry of the circuit boards.

It is a yet a further objective to provide positioning means to position the electrical connector to the circuit boards, and an aligning means to align the electrical circuit conductor to a resilient bias means positioned on the electrical connector.

The preferred embodiment of this invention comprises a space adjustable electrical connector used to interconnect electrical circuitry on one circuit board via a common electrical circuit conductor to corresponding circuitry on a spaced apart circuit board. The electrical connector comprises a first and a second housing which mate into a spacer by sliding engagement with one another through a plurality of tongues and grooves positioned on each housing. The grooves of one housing receive by one or more interlocks the tongues of the other housing at any of one of a plurality of predetermined distances. An electrical circuit conductor, which may be biased by resilient bias means positioned on each of housings, electrically engages a plurality of electrical conductive paths disposed on the electrical circuitry of each circuit board. The electrical circuit conductor adjusts to provide an electrical connection at any one of the predetermined distances between the spaced apart circuit boards. A protective latch may be secured to the spacer and positioned over the electrical circuit conductor.

The housings may include circuit board positioning means formed on the housing to correctly position the circuit boards, and conductor aligning means formed on the housing to correctly align the conductor. The tongue and grooves of the housing include interlocking surfaces, or interlocks, which may have a profile selected from a shapes and configurations. Each housing tongue may include a plurality of interlocks, such as rectangular projections, protruding from the tongue thereby forming a plurality of grooves having a plurality of interlocks, such as rectangular indentations. The grooves of one housing are disposed to receive tongues from the other housing.

The resilient bias means includes a canted spring disposed in a receiving cavity along the major axis of the housing on the housing surface adjacent to the circuit boards. The canted spring is positioned with the outer surface of the spring coils extending beyond the housing surface a predetermined distance. When the connector is juxtaposed between the circuit boards, the canted spring bears against the electrical circuit conductor and exerts a precalculated normal force on the electrical circuit conductor to engage circuitry on the circuit boards. This engagement provides a precise electrical connection to the plurality of electrical conductive paths formed on the circuit boards.

In another embodiment of the invention, a kit for use in constructing an electrical connector for spaced apart circuit boards comprises a first and second housing disposed to engage each other via a plurality of tongues and grooves positioned on each housing. The grooves of one housing receive via a plurality of interlocks the tongues of the other housing at one of a plurality of predetermined distances. The kit may include the resilient bias means, which may be positioned on the housings. Also, an electrical circuit conductor to electrically connect the spaced apart circuit boards and a protective latch may be included as part of the kit.

As pointed out in greater detail below, the electrical connector of this invention provides important advantages. Any one of a number of preselected spacings may be selected in order to provide cooling air and component spacing between the circuit boards. A common electrical circuit conductor is used in all of electrical connector spacings to electrically interconnect the plurality of conductive paths formed on the circuit boards. The rugged construction of the housings assures rigidity of the spacer which forms the electrical connector, which in turn assures precise electrical connection between the electrical circuit conductor and the circuit board circuitry. The resilient bias means asserts a preselected force on the conductor which assures the proper electrical engagement with the circuit board circuitry. The two identical housings, which mirror each other, mate together by sliding tongues and grooves formed into each housing. By positioning them so that different tongues and grooves engage, several overall heights are achievable. An electrical circuit conductor is positioned on each electrical connector surface adjacent to the circuit boards and deforms to adjust to the preselected spacing of the electrical connector.

The invention itself, together with further objects and attendant advantages, will best be understood by reference to the following detailed description, taken in conjunction with the accompanying drawing.

DETAILED DESCRIPTION OF THE PREFERRED EMBODIMENT

Figure 1:
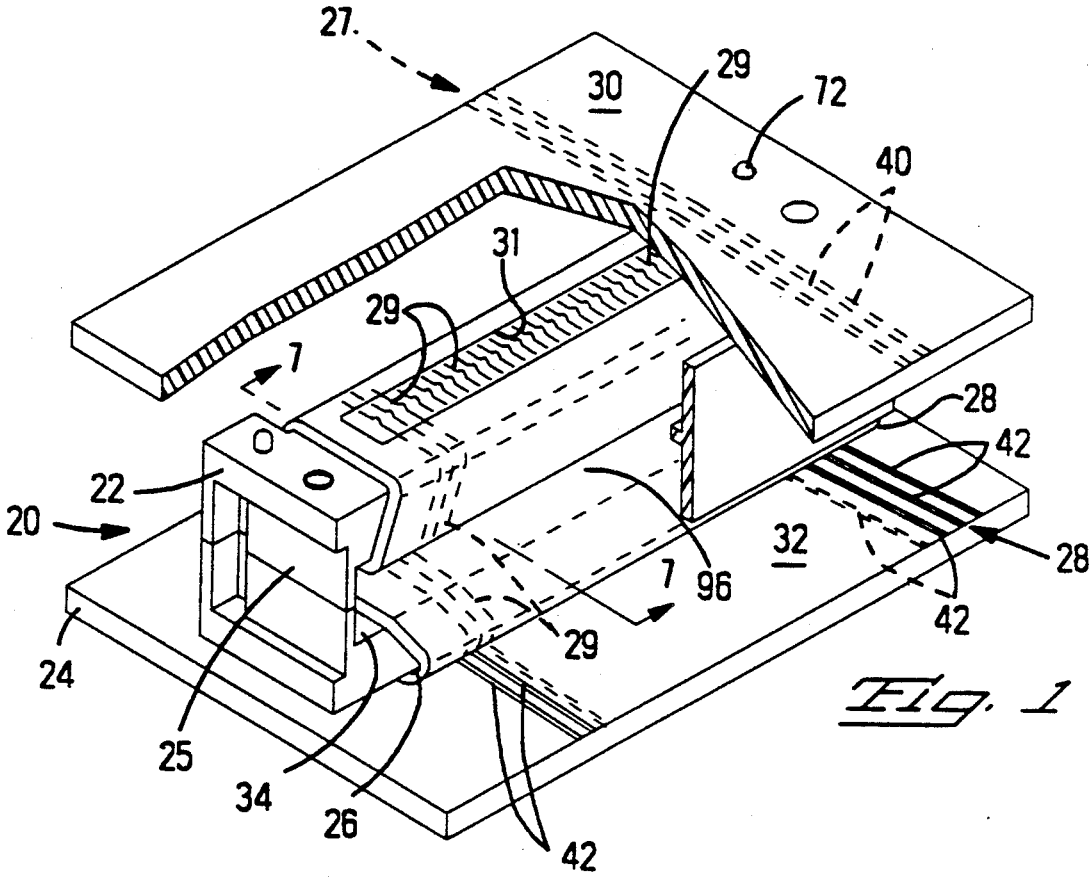
FIG. 1 is a fragmentary isometric view of the present invention connected to circuit boards.

Turning now to the drawing, FIG. 1 shows an electrical connector 20 that incorporates a first embodiment of this invention. The electrical connector 20 comprises a first and second housing 22,24 engaging to form a spacer 25 having an electrical circuit conductor member 26 interconnecting an array of conductors 29 with circuitry 27,28 between a parallel spaced apart first and second circuit boards 30,32 or substrates. A plurality of electrical conductive paths 40 formed on the circuitry 27 of the first circuit board 30 are connected by the electrical circuit conductor member 26 to electrical conductive paths 42 placed on the corresponding circuitry 28 of the second circuit board 32.

The term "electrical circuit conductor member" 26 is intended to be interpreted in its broadest sense to include a plurality of conductors 29 disposed on a surface of a flexible substrate or between two dielectric substrate layers. One such example is comprised of two layers of insulating film having a plurality of conductors disposed therebetween. One suitable film is Kapton, a polyimide film available from E.I. Du Pont de Nemours and Co. Other films as known in the art are also usable. To enable electrical interconnection between the opposed circuit boards 30,32, the outer layer of insulating material is removed at 31 to expose portions of conductors 29 overlying the resilient biasing means. A few conductors 29 have been indicated in FIG. 1 only. To simplify the figures and for ease of understanding the invention, the conductors 29 are not shown in the other Figures.

The at least one or a plurality of conductors 29 of circuit member 26 are exposed at 31 on both sides of the connector 20 and electrically connect corresponding at least one or a plurality of conductive paths 40,42 formed on the circuitry 27,28 of the circuit boards 30,32. For example, a suitable electrical circuit conductor member 26, such as flex film or the like, contains a number of conductors 29 which interconnect the plurality of electrical conductor paths 40,42 formed on the circuit boards 30,32. The electrical circuit conductor member 26 is made of deformable material and is disposed to fold into a storage notch 34 running the length of the housing 22,24. As can be appreciated, it is important that at least that the section of circuit conductor member 26 that is folded into storage notch 34 includes insulation on the outermost surface to prevent inadvertent shorting. A protective latch 36 is positioned over one surface of the electrical connector 20 to protect the electrical circuit conductor member 26.

As best shown in FIGS. 2, 3, 7 and 8, the electrical circuit conductor member 26 of FIG. 1 is biased into electrical engagement with the electrical conductive paths 40,42 on each circuit board 30,32 by resilient bias means 44, such as a canted spring 44', positioned within an elongated trough-shaped receiving cavity 46 in each of the housings 22,24. The elongated canted spring 44' is secured along the major axis Y-Y (shown in FIG. 2) of each housing 22,24 in the receiving cavity 46, which is formed on the housing surface 52 to be placed adjacent to the circuit boards 30,32.

Figure 8:
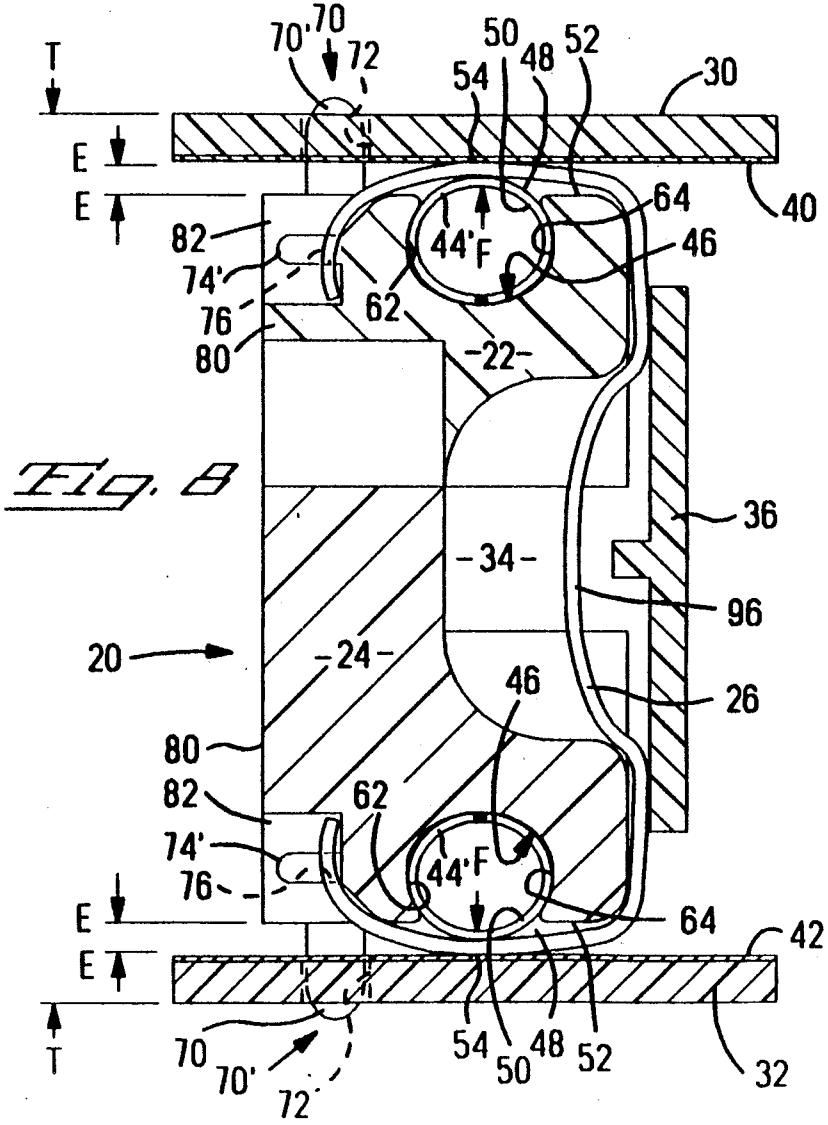
FIG. 8 is a cross sectional view of the electrical connector of FIG. 6 positioned between circuit boards in the tall space configuration.
Figure 7:
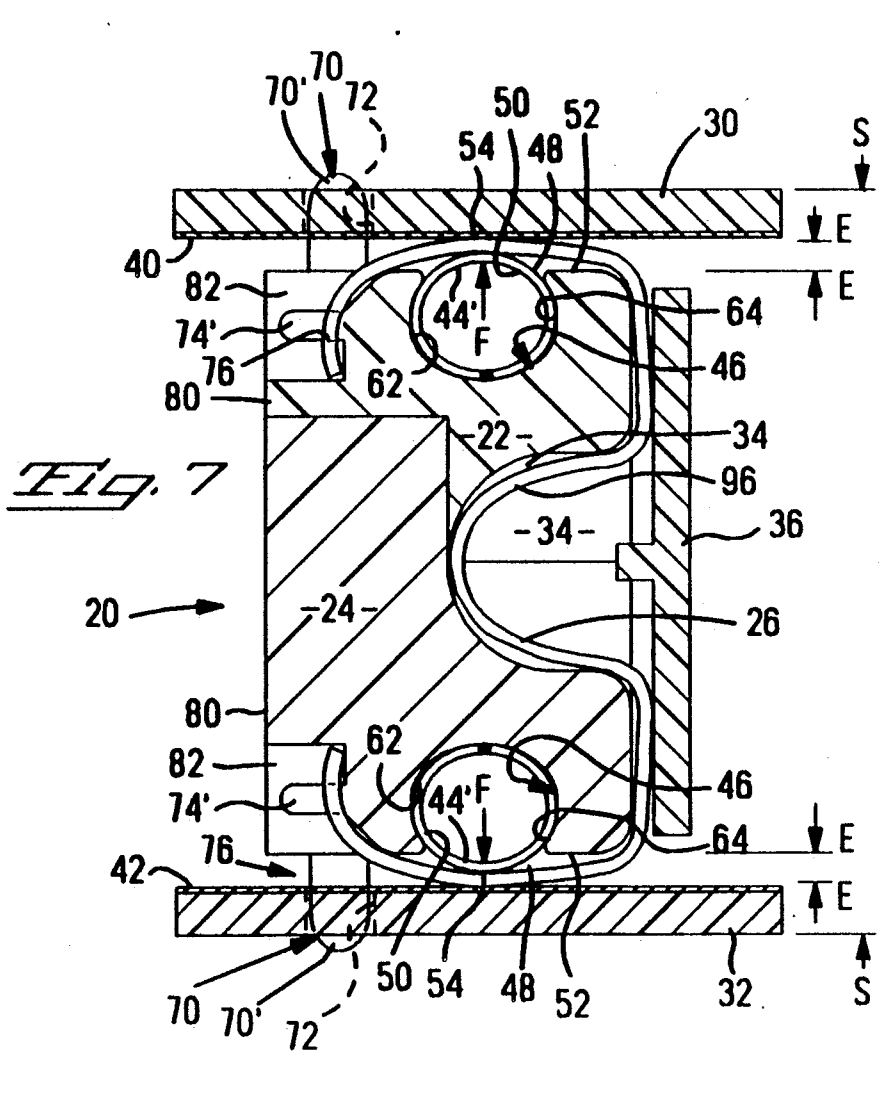
FIG. 7 is a cross sectional view of the electrical connector of FIG. 2 positioned between circuit boards in the short space configuration.

As shown in FIGS. 7 and 8, the canted spring 44' has an outer surface 48 of the spring coils 50 extending beyond the adjacent housing surface 52 a predetermined distance E-E. The canted spring 44' then exerts a precalculated normal force F on the electrical circuit conductor member 26 when the spring coils 50 are compressed by engagement with the circuit boards 30,32 as the adjacent housing surface 52 is juxtaposed with the circuit boards 30,32. This provides a precise electrical connection 54 between the corresponding electrical conductive paths 40,42 on the circuit boards 30,32 and the electrical circuit conductor member 26. A suitable material for the canted spring 44' is stainless steel or other resilient material. Preferably, the type and size of the canted spring 44', including the number of coils N per centimeter, are selected to provide the precise electrical connection 54 for a particular application.

The receiving cavity 46 is generally of an elongated trough shape with a truncated circle cross-section which defines gripping edges 62,64 which are spaced apart a distance less than the canted spring diameter 55. The edges 62,64 hold the canted spring 44' secure within each housing 22,24 in the following manner. The canted spring 44' is made of resilient material which enables it to deform sufficiently to be inserted into the receiving cavity 46 and once within the receiving cavity 46 regain its original shape. Because the gripping edges 62,64 are spaced apart a distance less than the canted spring diameter 55 (shown in FIG. 2), they hold the canted spring 44' secure in the receiving cavity 46. It is to be understood that the size and shape of receiving cavity 46 may be changed to accommodate different sizes or shapes of resilient biasing members 44 without departing from the spirit of the invention.

Figure 4:
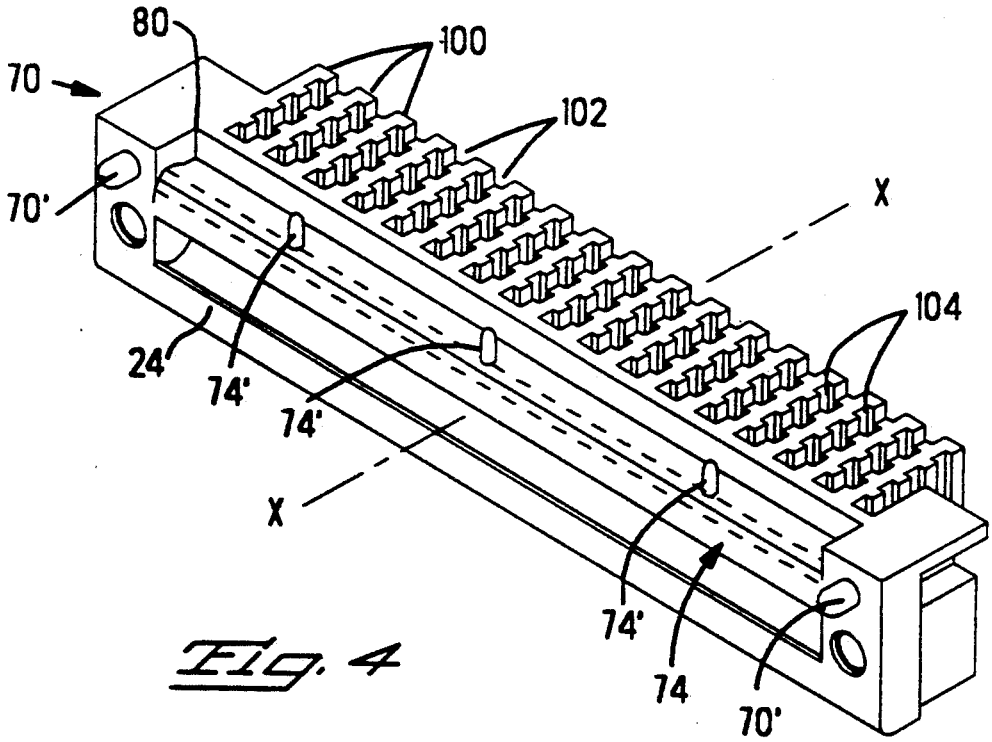
FIG. 4 is an isometric view of the housing of FIG. 2 showing the structure of a plurality of tongues and grooves formed along a minor axis of housings.
Figure 2:
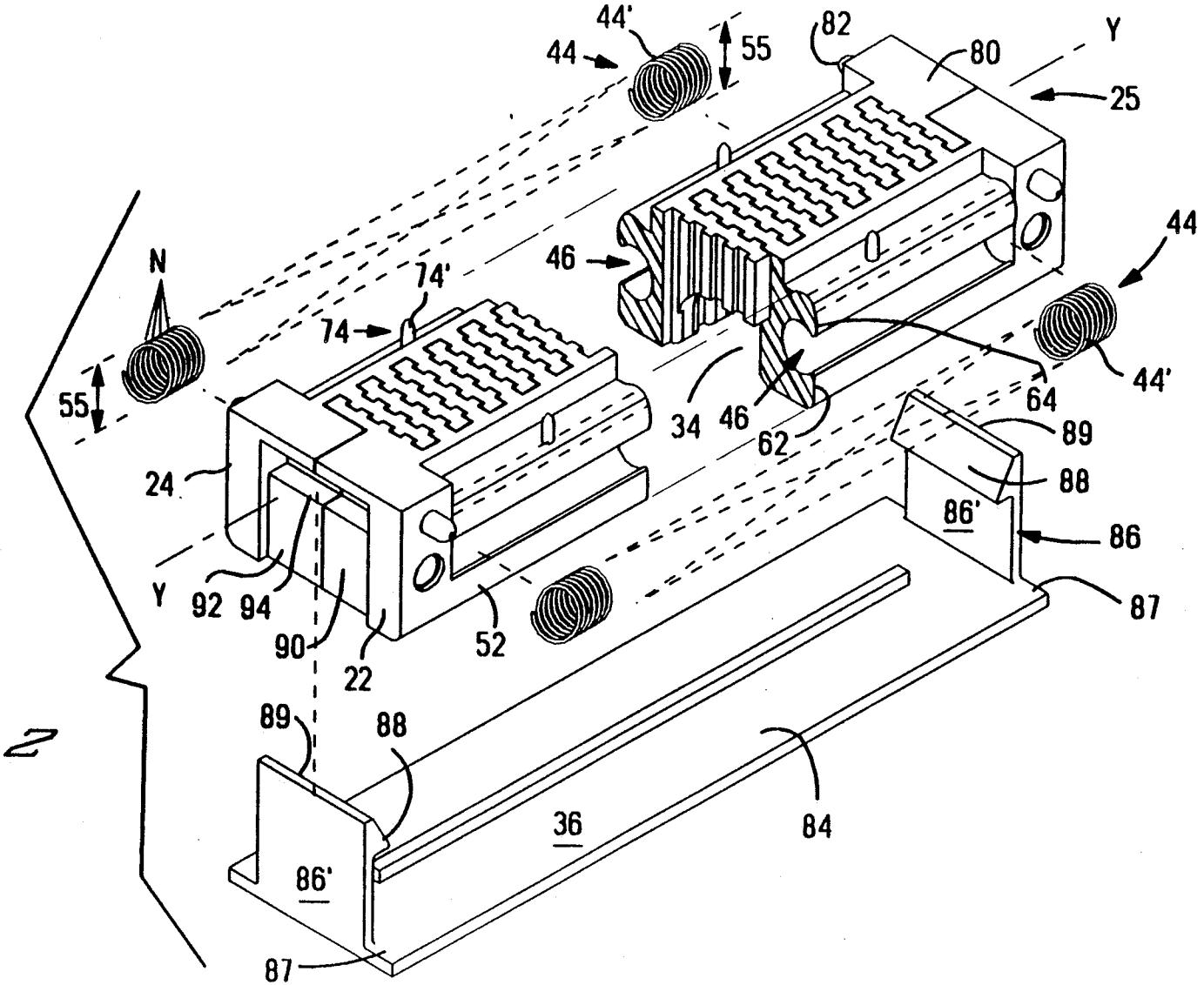
FIG. 2 illustrates an exploded fragmentary side isometric view of the electrical connector of FIG. 1 having a matched pair of housings assembled in a short space configuration.
Figure 3:
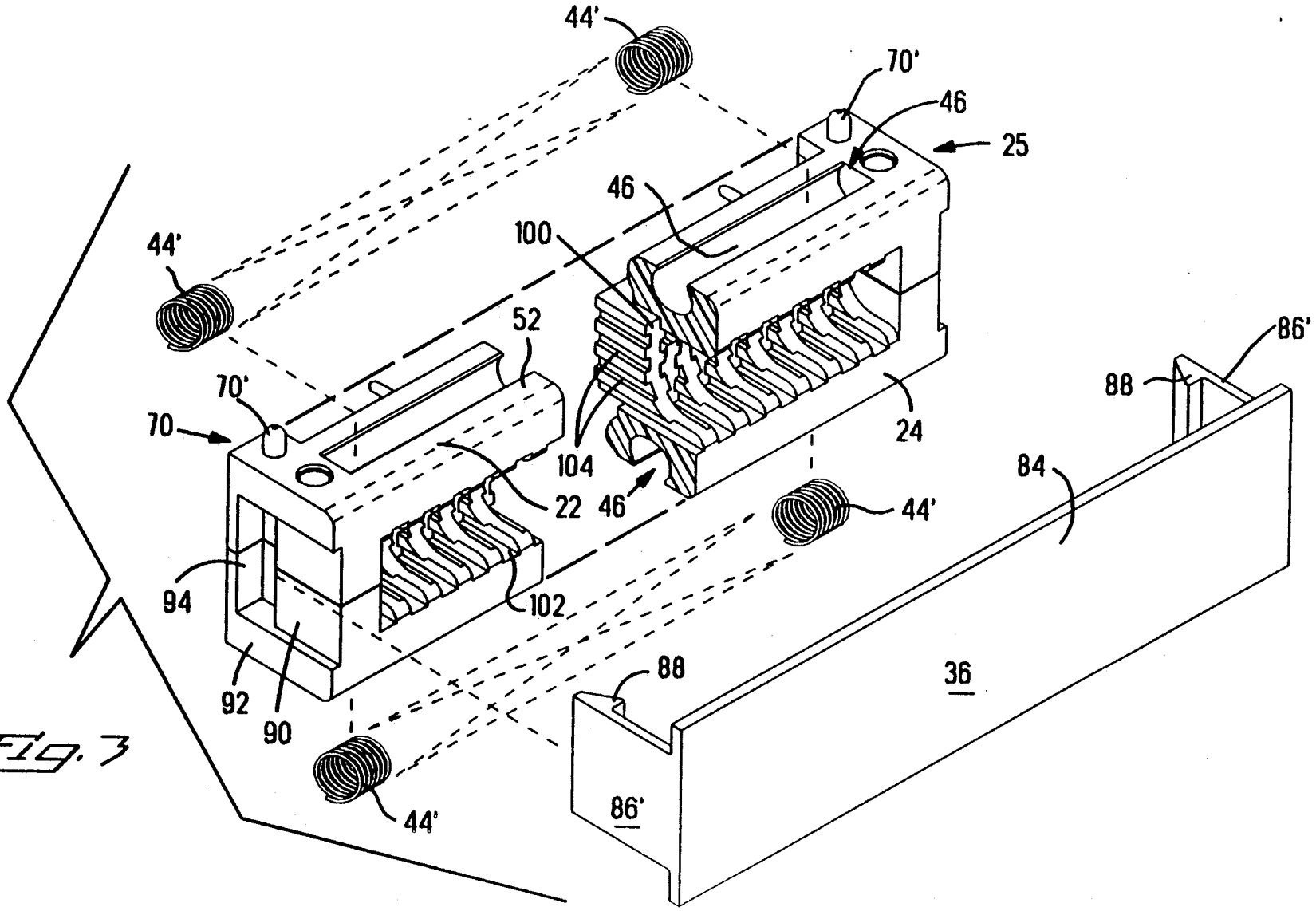
FIG. 3 illustrates an exploded fragmentary top isometric view of the electrical connector of FIG. 2.
Figure 5:
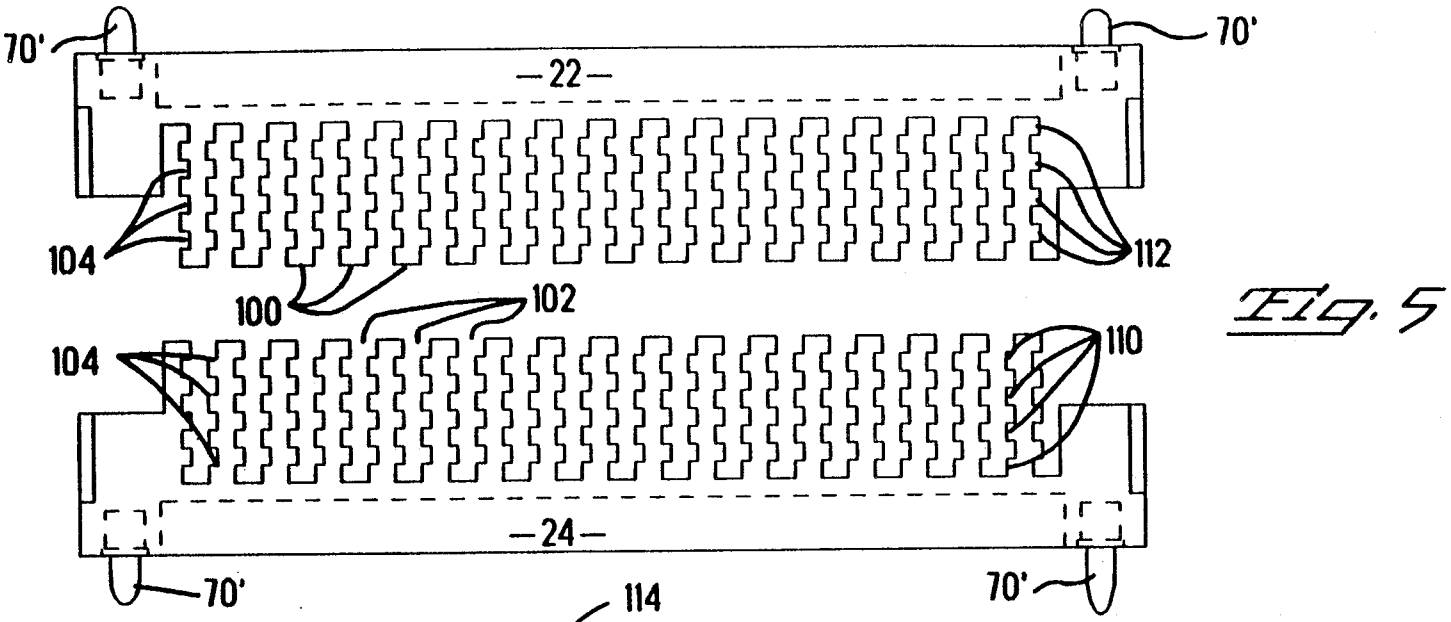
FIG. 5 is a top plan view of the matched pair of housings of FIG. 4 positioned for assembly into an electrical connector of FIG. 6.
Figure 6:
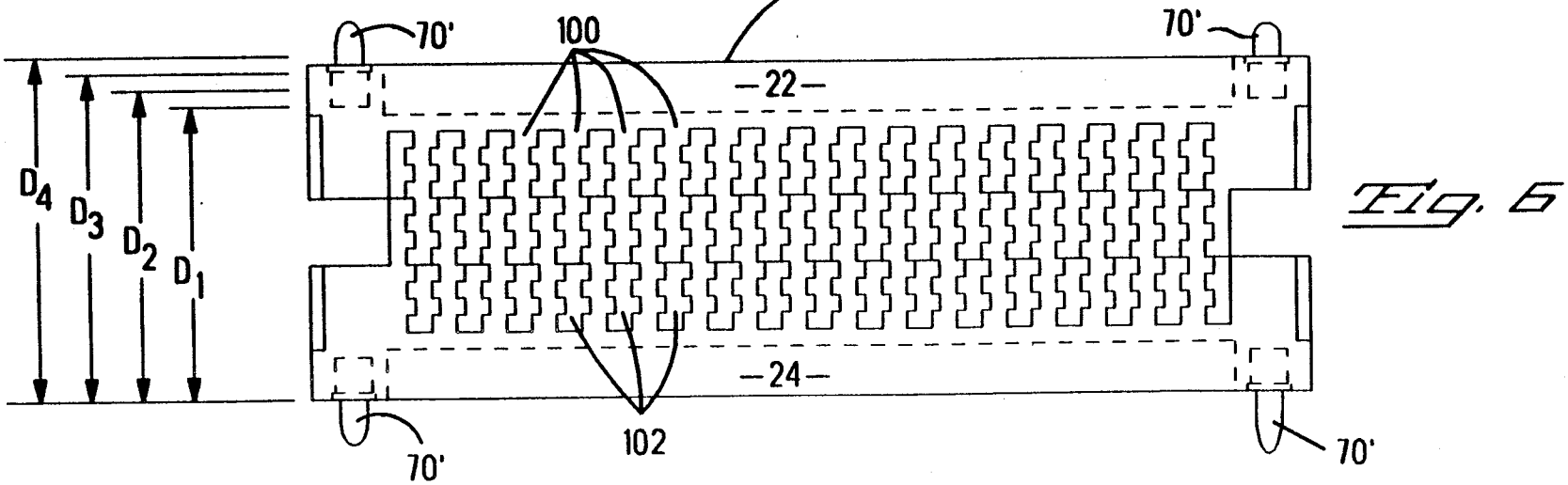
FIG. 6 is a top plan view of the matched pair of housings of FIG. 5 assembled to form an electrical connector in a tall space configuration.

As shown in FIGS. 4, 5 and 6, the first and second housing 22,24 of the electrical connector 20 each include circuit board positioning means 70, such as positioning projections 70', formed on the housing 22,24. The projections 70' correctly position the electrical connector 20 to the circuit board 30,32 by engaging circuit board openings 72, as best seen in FIGS. 7 and 8. The projections 70' are formed on the housing surface 52 positioned adjacent to the circuit board 30,32.

The first and second housing 22,24 also each include electrical circuit conductor member aligning means 74, such as aligning projections 74', formed on the housing 22,24 to correctly align the electrical circuit conductor member 26 by engaging openings 76 formed on the electrical circuit conductor members shown in FIGS. 7 and 8. The projections 74' are formed on non-adjacent housing surfaces 80 to the circuit board 30,32, and in recesses 82 horizontally disposed along the non-adjacent housing surface 80.

A protective latch 36 is designed to fit over an exposed surface 96 of the electrical circuit conductor member 26 as shown in FIGS. 7 and 8. Referring again to FIG. 2, the latch 36 includes a center section 84 with means 86 to engage the spacer 25, such as wings 86' formed on each end 87 of the center section 84. Each wing 86' has a flexible detent 88 formed near its end 89, which is disposed to engage a securing notch 90 formed on each end 92 of the housing 22,24. The wings 86' deform sufficiently to engage a ledge 94 of the securing notch 90 and securely attach the latch 36 to the spacer 25. The latch 36 forms a protective cover over a surface 96 of the electrical circuit conductor member 26.

As best shown in FIGS. 3, 4, 5 and 6, the first and second housing 22,24 are engaged with each other via a plurality of interlocking members, such as tongues 100 and grooves 102, positioned on each housing 22,24 to form the spacer 25. The tongues 100 and grooves 102 include a plurality of interlocks 104 which are oriented along the minor axis X-X. The grooves 102 of one housing 22,24 slide into the tongues 100 of the other housing 22,24 at the interlocks 104 disposed along the minor axis X-X at any of one of a plurality of predetermined distances D1,D2,D3,D4 between the first and second circuit board 30,32, as indicated in FIG. 6.

As best seen in FIG. 5, each housing tongue 100 includes a plurality of interlocks 104, such as rectangular projections 110, protruding from each side of the tongue 100 thereby forming a plurality of grooves 102 having a plurality of interlocks 104, such as rectangular indentations 112. The rectangular indentations 112 of one housing are disposed to receive the rectangular projections 110 from the other housing. As illustrated, each tongue 100 and groove 102 has four interlocks 104, such as rectangular projections 110 and rectangular indentations 112 respectively, which provide the spacer 25 with four space settings. Materials suitable to construct the housing 22,24 may be selected from the group consisting of plastics, nylon, and dielectric materials.

As shown in FIG. 5 and 6, each housing 22,24 has a plurality of extending tongues 100 forming grooves 102 between adjacent tongues 100. The tongues 100 of one housing 22,24 align with the grooves 102 of the other housing 22,24 to form the spacer 25 of interlocked construction. As illustrated, seventeen tongues 100 and seventeen grooves 102 from the spacer 25 engage one another which provides a rigid bearing surface 114 to support the resilient bias means 44. By having a large number of tongues 100, not only is a rugged electrical connector 20 formed, but one which provides precise control of the normal force F exerted by the resilient bias means 44. The number of tongues 100 and grooves 102 may be selected as needed to determine the rigidity of the electrical connector 20 and the nature of precise electrical connection 54 between the circuit boards 30,32 and the electrical circuit conductor member 26.

As shown in FIGS. 7 and 8, the ribbon of the electrical circuit conductor member 26 flexibly deforms and fits into the storage notch 34 which generally runs the length of each housing 22,24 and hence the length of the electrical connector 20. The latch 36 covers the exposed surface 96 of the electrical circuit conductor member 26 within the storage notch 34 and generally positioned between the circuit boards 30,32. Since the distance between aligning means 74 and spring receiving cavity 46 is fixed, the exposed portions 29 of conductors in member 26 can be precisely located at a given distance from the edge of member 26. Thus the same circuit conductor member 26 can be used for any of the various sizes of a particular adjustable stacking connector.

As best shown in FIGS. 7 and 8, the electrical connector 20 is shown in its short and tall space or height positions, S-S, T-T, respectively. As shown in FIG. 7, when the electrical connector 20 is assembled in the short space position S-S, the electrical circuit conductor member 26 is fully positioned within the storage notch 34. In contrast, when the electrical connector 20 is assembled the tall space position T-T, the electrical circuit conductor member 26 is deformed to be pulled out of the storage notch 34 and generally conforms to the surface of the latch 36.

Figure 9:
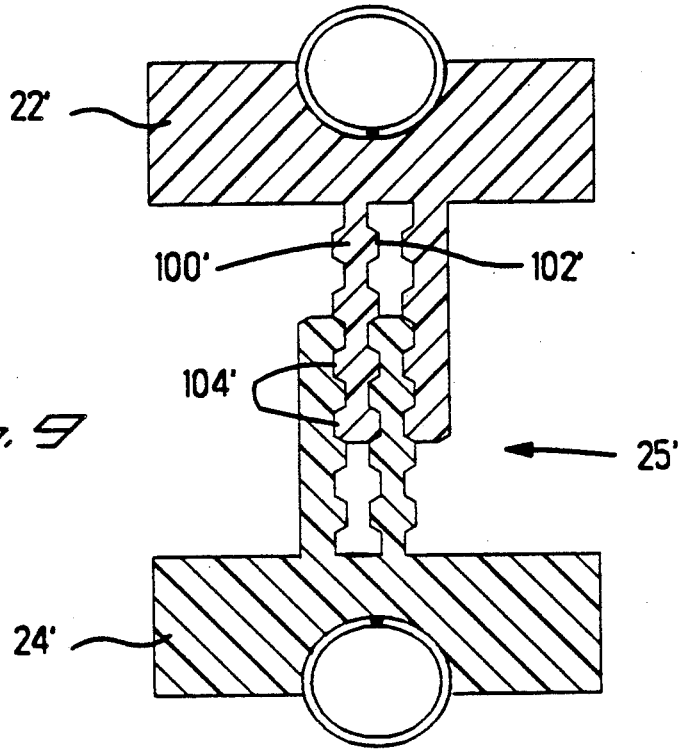
FIG. 9 is a fragmentary isometric view of a second embodiment of the invention where the first and second housings show tongues and grooves formed along a major axis of each housing.

Variations on the embodiments described above are possible. For example, while the above description describes interlocking members using tongues and grooves in sliding engagement, interlocking members using other engagement locking means are suitable, such as pins and sockets and projections and recesses. In one variation of the tongue and groove interlocking member, as shown in FIG. 9, a pair of housings 22',24' have tongues 100' and grooves 102' formed along the major axis Y-Y of the housings 22',24'. The pair of housings 22',24', which would be identical, would form a spacer 25' by sliding the two housings 22',24 together along the major axis Y-Y at preselected interlocks 104' disposed on the tongues and grooves 100', 102'.

Alternately, another electrical connector embodiment includes one housing having a large central tongue fitting within a large central groove of a second and different housing. Each housing would have mating tongue and groove interlocks which define a plurality of adjustable space settings.

It is also pointed out that the invention is not limited to the above embodiments describing engagement surfaces 113 of the tongue and groove interlocks 104 along the minor axis X-X, and the major axis Y-Y. While a range of ninety degrees between the major and minor axis X-X,Y-Y is illustrated, the invention may also be practiced having the angle of the engagement surfaces 113 of the interlocks 104 at any angle ranging between the major and minor axes X-X,Y-Y.

Figure 10A:
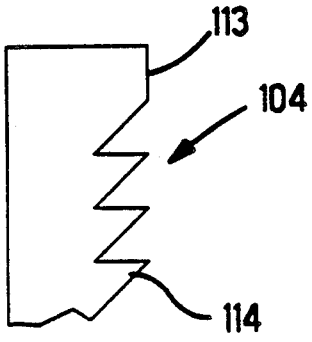
FIGS. 10A, 10B and 10C are enlarged cross sectional views of tongue and groove interlocking structures using sawtooth, truncated circular, and truncated triangular interlocks, respectively.
Figure 10B:
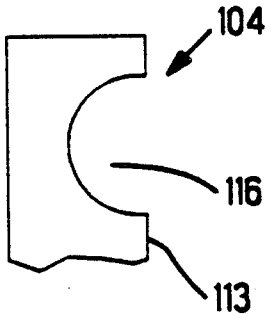
Figure 10C:
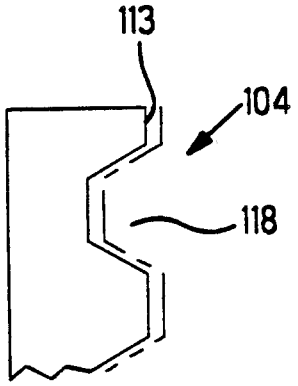

In another variation, as shown in FIG. 10A, 10B and 10C, the tongues 100 and grooves 102 may include interlocks 104 selected from the group consisting of sawtooth 114, truncated circles 116, and truncated triangles 118, respectively. In addition other interlocks 104, such as sine waves, "S" shapes, ridges and the like, may be used on the tongue and groove engagement surface 113.

In yet another variation, electrical circuit conductor members 26 may, in addition to flex film, comprise deformable ribbon conductors having a plurality of conductor channels 29. Other electrical circuit conductor members having properties of suitable deformation within the storage notch 34, positive connection to the positioning means 70, and a plurality of conductor channels 29 may also be used.

As yet another variation, the space adjustable electrical connector 20 may be packaged as a kit, which may be assembled to electrically connecting spaced apart circuit boards 30,32. The kit comprises a pair of housings 22,24 of FIGS. 2 and 3 which are disposed to be engaged with each other via a plurality of tongues 100 and grooves 102 positioned on each housing 22,24. Each of the housings 22,24 are constructed in a manner where the grooves 102 of one housing 22,24 is disposed to receive and interlock the tongues 100 of the other housing 22,24 at one of a plurality of predetermined distances D1,D2,D3,D4 selected to provide spacing between the circuit boards 30,32. Also, the electrical circuit conductor member 26 and the resilient bias means 44 may be optionally included in this kit.

The embodiments of the electrical connector described above provide a number of significant advantages. The electrical connector 20 may be set at any one of a number of preselected spacings in order to provide cooling air and component spacing between spaced apart boards 30,32. The common electrical circuit conductor member 26 is used to electrically interconnect the circuit boards 30,32 at all of the spacings of the electrical connector 20. The two housings 22,24 mirror each other and engage each other by sliding the tongues 100 of one housing 22,24 into the grooves 102 of the other housing 22,24. By positioning different tongue interlocks 104 in alignment with different groove interlocks 102, a plurality of predetermined distances D1,D2,D3,D4 are achievable.

The rugged construction of a spacer 25 having a plurality of tongues 100 and grooves 102 assures rigidity of the electrical connector 20 which provides for the precise electrical connection 54 between electrical circuit conductor member 26 and the circuit boards 30,32. The resilient bias means 44 asserts a normal force F on the electrical circuit conductor member 26 which provides for the precise electrical connection 54 with the circuit boards 30,32. The ends of electrical circuit conductor member 26 are positioned on housing surfaces 52 which are adjacent to the circuit boards 30,32, which allows the electrical circuit conductor member to deform into a storage notch 34 running the length of the housings 22,24 as the electrical connector is set between short and tall positions S-S,T-T.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of the invention.

We claim:

1. An electrical connector for electrically connecting corresponding circuits on opposed surfaces of spaced apart parallel circuit boards comprising:

a first and a second housing engaged with each other via a plurality of integral interlocking members positioned on each housing, corresponding ones of said integral interlocking member of one housing interlocking with corresponding ones of said other integral interlocking members of the other housing to form a spacer having one of a plurality of predetermined distances defined by engagement of said interlocking members;

an electrical circuit conductor attached to said spacer and disposed to electrically engage a plurality of electrical conductive paths positioned on each of said circuit boards, said electrical circuit conductor being adjustable to provide electrical connection between the circuit boards at any one of said predetermined distances.

2. The electrical connector of claim 1, wherein each of said housings include resilient bias means positioned on said housing surface adjacent to said circuit boards, said resilient bias means engaging said electrical circuit conductor to said electrical conductive paths with a preselected normal force upon engagement of said housing surface to said circuit boards, said predetermined distances defined by spacing between said circuit boards.

3. The electrical connector of claim 2, wherein each of said housings includes a receiving cavity on said housing surface adjacent to said circuit boards to receive said resilient biasing means, said resilient biasing means comprising a canted spring disposed in said receiving cavity to position the outer surface of spring to provide said preselected normal force to engage said electrical circuit conductor to said electrical conductive paths.

4. The electrical connector of claim 1, wherein said first and second housings each include positioning means to correctly position said circuit boards to said electrical connector, and aligning means to correctly align said electrical circuit conductor to said electrical conductive paths.

5. The electrical connector of claim 1, wherein each of said housing interlocking members comprise tongues and grooves which include an interlock of a shape selected from the group consisting of squares, rectangles, triangles, sawtooth, truncated circles, truncated triangles, sine waves, or "S" shapes.

6. The electrical connector of claim 5, wherein tongue and groove interlocks include a plurality of rectangular projections protruding from at least one side of said tongue thereby forming a plurality of grooves having a plurality of rectangular indentations disposed to receive tongues from said other housing.

7. The electrical connector of claim 1, wherein each of said housings include material selected from the group consisting of plastics, nylon, and dielectric materials.

8. The electrical connector of claim 4, wherein said positioning means comprises a plurality of positioning projections extending from said housing surface adjacent to said circuit boards, said circuit boards having a plurality of matched openings to receive said positioning projections, and said aligning means comprises a plurality of aligning projections disposed on a housing recess defined on a nonadjacent housing surface to said circuit boards, electrical circuit conductors having a plurality of matched openings to receive said aligning projections.

9. The electrical connector of claim 1, additionally comprising a latch having means engaging the spacer to provide a protective surface over said electrical circuit conductor.

10. A kit for constructing a space adjustable electrical connector for electrically connecting corresponding circuits on opposed surfaces of spaced apart parallel circuit boards comprising:

a pair of housings defining a plurality of integral interlocking members positioned on each housing, said interlocking members of one housing disposed to engage with said interlocking members of the other housing to define by engagement of said members to form a spacer having one of a plurality of predetermined distances which match said space between said parallel circuit boards;

an electrical circuit conductor adapted to be attached to said spacer and disposed to engage a plurality of electrical conductive paths positioned on said parallel circuit boards, said electrical conductor being adjustable to provide electrical connection at any one of said predetermined distances between said circuit boards; and a pair of resilient biasing means disposed to position the electrical circuit conductor in normal force engagement with conductive paths on said circuit boards.

11. The kit of claim 10, additionally comprising a latch having means to engage said latch to the assembled housings forming said electrical connector to provide a protective cover over the surface of said electrical circuit conductor.

12. The kit of claim 10, wherein said housings each include positioning means formed on said housings to correctly position said electrical connector to said circuit boards, and aligning means to correctly align said electrical circuit to said electrical conductive paths.

13. The kit of claim 10, wherein each of said housings includes a receiving cavity on an adjacent surface of each housing to receive a resilient bias means, said housings constructed of material selected from the group consisting of plastics, nylon, and dielectric materials.

14. The kit of claim 10, wherein each of said housing interlocking members comprise tongues and grooves which include an interlock of a shape selected from the group consisting of squares, rectangles, triangles, sawtooth, truncated circles, truncated triangles, sine waves, or "S" shapes.

15. The connector of claim 14, wherein each of said housing interlocks include a plurality of rectangular projections protruding from at least one side of said tongue thereby forming a plurality of grooves having a plurality of rectangular indentations disposed to receive tongues from said other housing.

16. The kit of claim 10, wherein said positioning means comprise a plurality of positioning projections extending from said housing surface disposed to be adjacent to said circuit boards, and said aligning means comprises a plurality of aligning projections disposed on a recess formed on a housing surface non-adjacent to said boards.

17. The kit of claim 10, wherein said resilient bias means comprises an canted spring disposed to be positioned along the major axis of said housing in a receiving cavity on the housing surface disposed to be adjacent to said circuit boards, whereby said canted spring having the outer surface of said spring coils extending beyond said housing surface a predetermined distance to exert a precalculated normal force upon said electrical connector engaging said circuit boards along on said adjacent housing surface.

18. A housing for forming an adjustable size spacer for use in electrically interconnecting corresponding circuits on opposed surfaces of spaced apart parallel circuit boards comprising a body having a plurality of interlocking members defining a plurality of interlocks engageable at any one of a plurality of predetermined distances, said interlocks being structured to receive in engagement therewith complementary interlocks from another housing at any one of said plurality of predetermined distances, the interlocking housings thereby defining a spacer having a plurality of adjustable space settings.

19. The housing of claim 18, wherein said interlocking members comprise a plurality of tongues and grooves defining engagement surfaces, said surfaces having shapes ranging from an angle defined by a major axis of said housing to an angle defined by a minor axis of said housing.

20. The housing of claim 19, wherein said housing further includes resilient bias means positioned on one housing surface.

* * * * *

UNITED STATES PATENT AND TRADEMARK OFFICE

CERTIFICATE OF CORRECTION

PATENT NO. : 5,069,627

DATED : December 3, 1991

INVENTOR(S) : Jonathan E. Buck, et al.

It is certified that error appears in the above-identified patent and that said Letters Patent is hereby corrected as shown below:

Claim 15, line 25, column 10, delete the word "connector" and insert the word --kit--.

Signed and Sealed this

Sixth Day of July, 1993

*Attest:*

Michael K. Kirk

MICHAEL K. KIRK

*Attesting Officer*

*Acting Commissioner of Patents and Trademarks*